US012041965B1

(12) United States Patent
Qi

(10) Patent No.: US 12,041,965 B1
(45) Date of Patent: Jul. 23, 2024

(54) HOOKAH HEATING DEVICE

(71) Applicant: Guanghui Qi, Xinning (CN)

(72) Inventor: Guanghui Qi, Xinning (CN)

( * ) Notice: Subject to any disclaimer, the term of this patent is extended or adjusted under 35 U.S.C. 154(b) by 0 days.

(21) Appl. No.: 18/505,725

(22) Filed: Nov. 9, 2023

(30) Foreign Application Priority Data

Sep. 25, 2023 (CN) ..... 202311241333.9

(51) Int. Cl.
*A24F 1/30* (2006.01)

(52) U.S. Cl.
CPC ..... *A24F 1/30* (2013.01)

(58) Field of Classification Search
CPC ..... A24F 1/30
See application file for complete search history.

(56) References Cited

U.S. PATENT DOCUMENTS

2019/0320712 A1* 10/2019 Rix ..... A24F 1/30
2019/0350253 A1* 11/2019 Bavar ..... H05B 3/06
2021/0267274 A1* 9/2021 Zhang ..... A24F 1/30
2022/0264941 A1* 8/2022 Zoumut ..... A24F 5/10

* cited by examiner

*Primary Examiner* — Dennis R Cordray
(74) *Attorney, Agent, or Firm* — Muncy, Geissler, Olds & Lowe, P.C.

(57) ABSTRACT

A hookah heating device comprises a charcoal tray and a tobacco bowl. The tray has a base and a barrier, each with an air flow passage. A central column connects the base to a smoke pipe, and the bowl is detachably connected to the column. A hood is placed on top of the bowl. The barrier's exterior has a movable cover body to adjust the second passage size. When fully covered, a first chamber forms between the base and the bowl's bottom. By adjusting the cover body, the burning intensity of the charcoal can be controlled, regulating the tobacco's heating temperature. The bowl's design above the tray maximizes the utilization of the charcoal's released heat.

9 Claims, 11 Drawing Sheets

HOOKAH HEATING DEVICE

TECHNICAL FIELD

The present application relates to the field of hookah technology, and more specifically, to a hookah heating device.

BACKGROUND

A hookah is a device used for smoking flavored tobacco, where smoke produced by igniting the tobacco on a charcoal placed in the upper charcoal tray of the hookah is filtered through water in the lower water tank of the hookah and then inhaled. In order to achieve complete combustion of the charcoal and regulate the amount of smoke, the charcoal tray and/or the tobacco bowl, which holds the tobacco, are typically equipped with ventilation holes and/or devices for adjusting the size of the air holes.

For example, CN111084420A discloses a hookah pot heating device that supplies heat to the hookah pot through a hot air conduit and regulates the burning of tobacco paste in the hookah pot through an air conduit. In this solution, the charcoal tray is positioned above the hookah pot, and the heat generated by the burning charcoal is delivered to the hookah pot through the hot air conduit. One end of the air conduit is connected to the atmosphere, and the other end is connected to the hookah pot. When a user smokes the hookah, negative pressure is formed inside the hookah pot due to inhalation, and outside air is drawn into the hookah pot through the air valve and air conduit, resulting in more complete combustion of the tobacco paste.

CN211794298U discloses a hookah heat adjustment device, which consists of a top cover and a base for holding the charcoal. The device adjusts the heat by regulating the burning speed of the charcoal. In this solution, the side wall of the base is provided with an air inlet. At the corresponding position of the air inlet, a blocking portion extends downward from the top cover. The blocking portion can partially block the air inlet to adjust the amount of air entering through the air inlet.

Similarly, U.S. Ser. No. 11/206,866B2 discloses a heating unit for a hookah. In this solution, the heating unit is positioned above the cooking unit (tobacco heating unit), and the size of the top ventilation channel is adjusted by rotating the top cover of the heating unit to control the amount of air flowing into the heating unit, thereby controlling the combustion inside the heating unit.

In the existing art, including the aforementioned solutions, the hookah pot is positioned below the charcoal tray, so a significant portion of the heat generated by the burning charcoal is dissipated into the air and cannot be efficiently used for heating and combustion of the tobacco in the hookah pot. Additionally, the charcoal tray is either directly exposed to the air or the airflow is regulated solely by rotating a single outer shell/top cover to adjust the degree of charcoal burning/heat, ultimately achieving the goal of regulating the amount of smoke. However, these methods do not allow for precise heat adjustment of the charcoal tray and cannot achieve the desired smoking state for hookah users.

SUMMARY

Based on this, the purpose of the present application is to provide a hookah heating device with higher thermal efficiency and more precise heat adjustment for a hookah pot.

The hookah heating device includes a charcoal tray for holding charcoal and a tobacco bowl for holding tobacco.

The charcoal tray includes a base and a surrounding barrier set around the base. The base has a first passage for air circulation, and the barrier has a second passage for air circulation.

The center of the base has a central column connected to the smoke pipe, and the tobacco bowl is detachably connected to the upper end of the central column and communicates with the central column. The top of the tobacco bowl has a cover body.

The outer side of the barrier has a hood that can move up and down relative to the barrier to adjust the size of the second passage. When the second passage is completely blocked by the hood, the hood seals the first chamber between the base and the bottom of the tobacco bowl.

Preferably, the barrier has at least one adjustment member along the vertical direction, and the hood adjusts the size of the second passage by falling on different adjustment members.

Preferably, the barrier includes several spaced-apart baffles around the base, and the gaps between adjacent baffles form the second passage.

The hood is preferably provided with notched ledges that protrude towards the center of the inner wall bottom at spaced intervals. When the notched ledges fall on the base, the baffles are wedged between the adjacent notched ledges, and the hood seals the first chamber.

More preferably, the baffles have at least one block protruding towards the side edge along the vertical direction, and the notched ledges adjust the size of the second passage by falling on different blocks.

Preferably, the first passage includes several air flow ribs extending outward from the center of the base and several air flow holes set between the air flow ribs.

Preferably, the center of the tobacco bowl has a connecting hole connected to the central column. The section of the tobacco bowl from the rim to the connecting hole has an upwardly open arc shape.

Preferably, the tobacco bowl has several temperature control holes communicating with the first chamber.

More preferably, the upper end of the central column has external threads, and the connecting hole has internal threads that match the external threads. The central column and the connecting hole are connected by the external threads and the internal threads.

Preferably, the rim of the tobacco bowl has a downwardly extending bowl cover that is not lower in height than the tobacco bowl.

The cover body is provided with a sealing protrusion extending horizontally outward at the connection with the edge of the bowl, which is used to seal the second chamber between the cover body and the tobacco bowl.

Preferably, the hood has an adjustment handle for moving the hood up and down, and the bowl cover has a rotating handle for rotating the tobacco bowl.

The technical solution protected by this application has the following beneficial effects:

1) During the smoking process of the hookah, as the charcoal burns, the water vapor in the tobacco bowl evaporates and releases smoke. When the smoke output is too high or too low, the air volume inside the charcoal tray can be adjusted by moving the hood up and down to control the burning degree of the charcoal, thereby achieving precise control of the heating temperature of the hookah and ultimately achieving precise control of the smoke size.

2) Since the heating device of the tobacco bowl is located above the charcoal, compared with the design of the charcoal tray set on the upper part of the tobacco bowl, it can reduce the heat generated by the burning of the charcoal in the air, more effectively utilize the heat released by the burning of the charcoal, increase the utilization rate of energy, and reduce the number of times and quantity of charcoal replacement. Since the central column of the charcoal tray and the tobacco bowl are detachably connected through threads, the distance between the charcoal tray and the tobacco bowl can be adjusted by rotating the tobacco bowl. When the hood cannot quickly make the smoke reach the ideal smoking state, the tobacco bowl can be rotated to increase the distance between the charcoal tray and the tobacco bowl, so that the heat can quickly dissipate into the air, thereby achieving the purpose of quickly controlling the smoke output.

3) Since the central column of the charcoal tray and the tobacco bowl are detachably connected through threads, the distance between the charcoal tray and the tobacco bowl can be adjusted by rotating the tobacco bowl. When the hood cannot quickly make the smoke reach the ideal smoking state, the tobacco bowl can be rotated to increase the distance between the charcoal tray and the tobacco bowl, so that the heat can quickly dissipate into the air, thereby achieving the purpose of quickly controlling the smoke output.

BRIEF DESCRIPTION OF THE DRAWINGS

To provide a clearer description of the technical solution in the present application, the accompanying drawings used in the description of the embodiments will be briefly introduced below. The following description of the drawings is only for the embodiments disclosed herein. Ordinary skilled persons in the art can obtain additional drawings based on the provided drawings without exercising inventive labor.

DETAILED DESCRIPTION OF THE EMBODIMENTS

Figure 1:
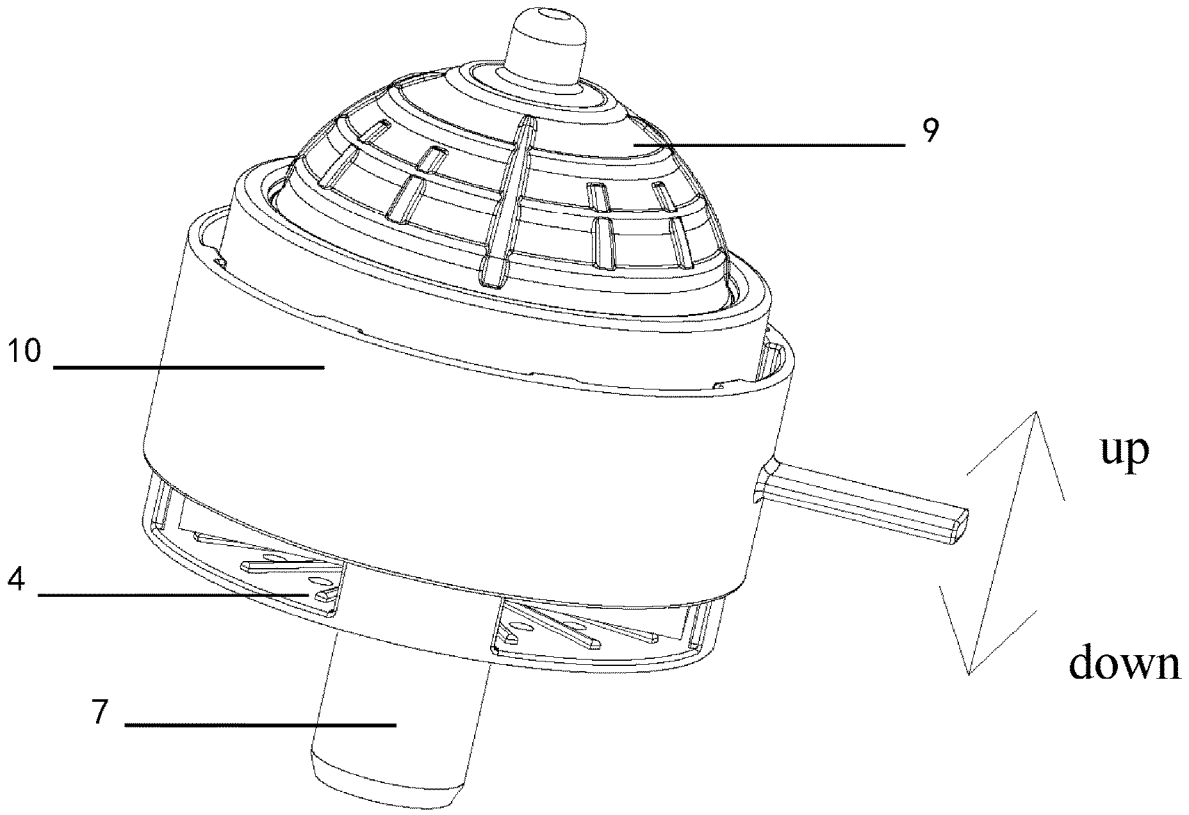
FIG. 1 illustrates a schematic diagram of the hood moving up and down along the charcoal tray.
Figure 2:
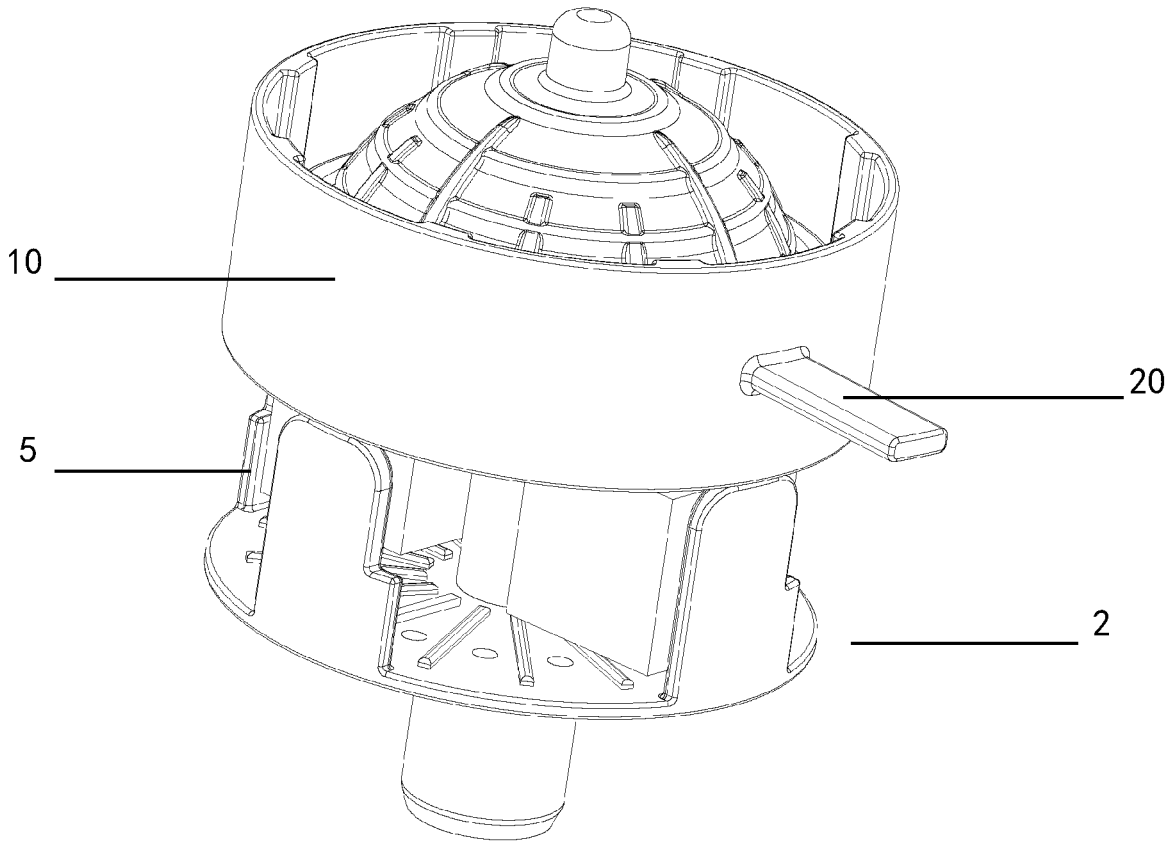
FIG. 2 illustrates a schematic diagram of the hood moving upward along the charcoal tray.
Figure 3:
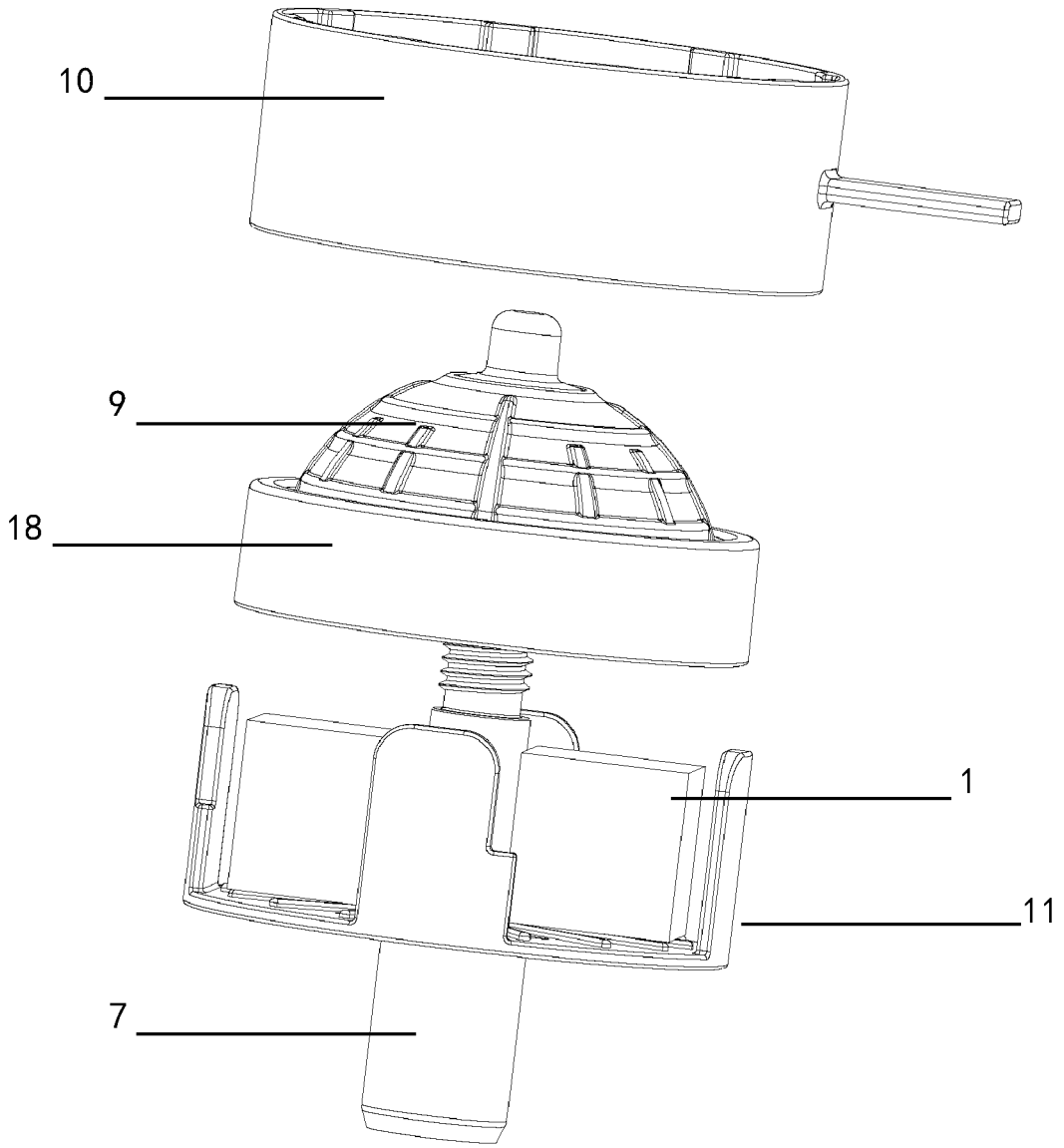
FIG. 3 illustrates another schematic diagram of the hood moving upward along the charcoal tray.
Figure 4:
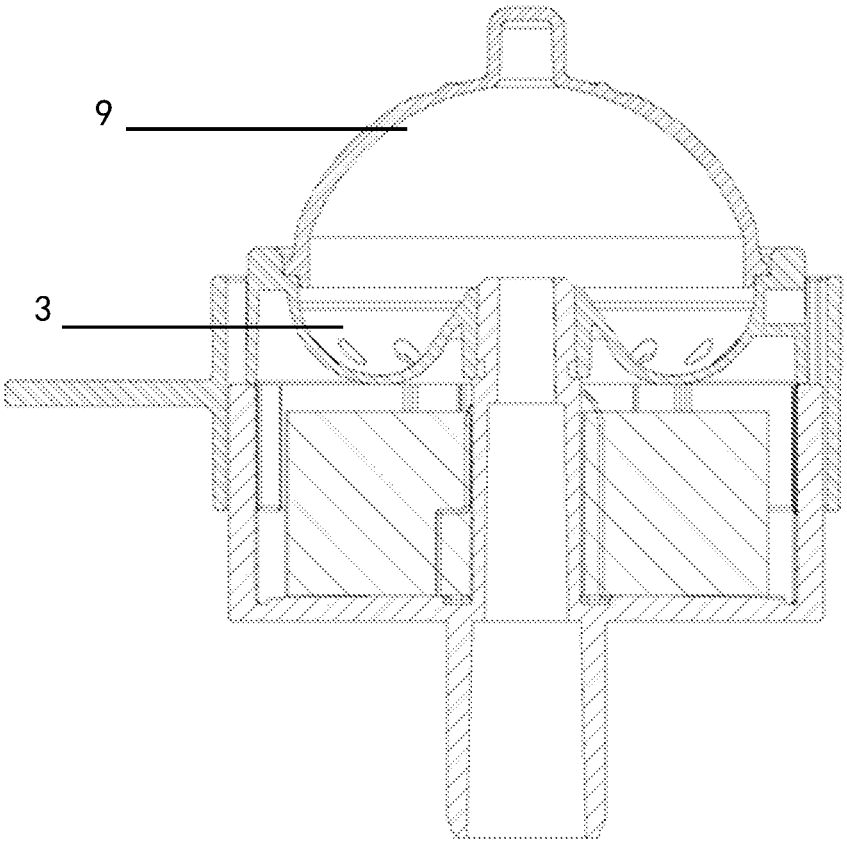
FIG. 4 illustrates a sectional view of the connection between the tobacco bowl and the non-threaded central column.
Figure 5:
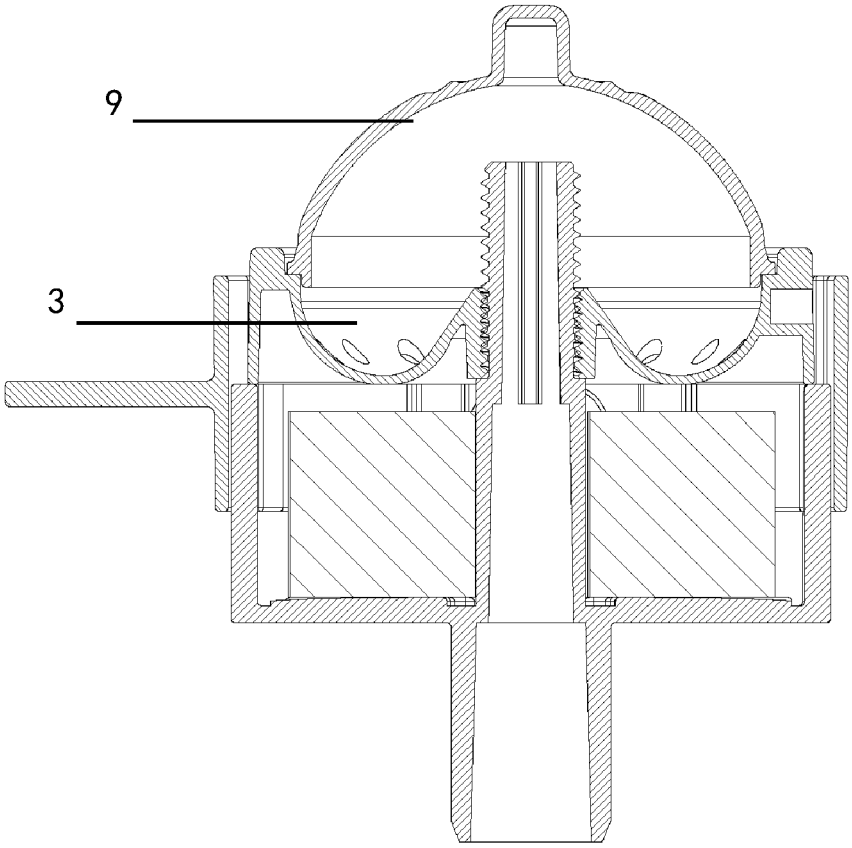
FIG. 5 illustrates a sectional view of the connection between the tobacco bowl and the central column using threads.

To clarify the purpose, technical solution, and beneficial effects of the embodiments disclosed herein, the following description, in conjunction with the accompanying drawings, will provide a clear and complete description of the technical solution in the embodiments disclosed herein. It should be noted that the described embodiments are only a part of the embodiments disclosed herein, and not the entirety of the embodiments. Based on the disclosed embodiments, all other embodiments obtained by those skilled in the art without any creative effort are within the scope of protection of the present application.

As shown in FIGS. 1-14, the hookah heating device in this embodiment includes a charcoal tray 2 for placing charcoal 1 and a tobacco bowl 3 for placing tobacco. The charcoal tray 2 comprises a base 4 and a barrier 5 set around the base 4. The base 4 is provided with a first passage for air circulation, and the barrier 5 is provided with a second passage 6 for air circulation.

The center of the base 4 is provided with a central column 8 connected to a smoke pipe 7. The tobacco bowl 3 is detachably connected to the upper end of the central column 8 and communicates with it. The top of the tobacco bowl 3 is provided with a cover body 9.

The exterior of the barrier 5 is equipped with a hood 10, which can move up and down relative to the barrier 5 to adjust the size of the second passage 6. In a preferred embodiment, the hood 10 is equipped with an adjustment handle 20 made of heat-resistant material for moving the hood 10 up and down. When the second passage 6 is completely covered by the hood 10, the hood 10 seals the first chamber between the base 4 and the bottom of the tobacco bowl 3.

During the operation of the hookah heating device, an appropriate amount of tobacco is evenly spread in the tobacco bowl 3, pre-burned charcoal 1 is placed in the charcoal tray 2, and the tobacco bowl 3 is connected to the central column 8 and covered with the cover body 9. As the charcoal 1 burns, the tobacco in the tobacco bowl 3 evaporates and releases smoke. By adjusting the amount of air in the charcoal tray 2 through the up and down movement of the hood 10, the burning intensity of the charcoal 1 can be controlled, thereby achieving precise control over the heating temperature of the tobacco and ultimately achieving precise control over the size of the smoke.

Furthermore, compared to the design where the charcoal tray is placed on the upper part of the tobacco bowl, the design in this embodiment, with the tobacco bowl 3 positioned above the charcoal 1, reduces the dissipation of heat generated by the burning charcoal in the air, resulting in more efficient utilization of the heat released by the burning charcoal, increased energy utilization, and reduced frequency and quantity of charcoal replacement. Since the base of the charcoal tray is also equipped with the first passage for air circulation, when the hood 10 completely covers the second passage 6, the charcoal 1 can continue to burn at a minimal level without extinguishing, allowing for continued use without the need to re-burn the charcoal.

In the preferred embodiment, to further accurately and conveniently control the airflow in the charcoal tray, the barrier 5 is provided with at least one adjustment member along the vertical direction. The hood 10 adjusts the size of the second passage 6 by falling on different adjustment members, thereby adjusting the airflow in the charcoal tray 2 according to the size of the smoke, achieving control over the burning intensity of the charcoal 1.

Figure 11:
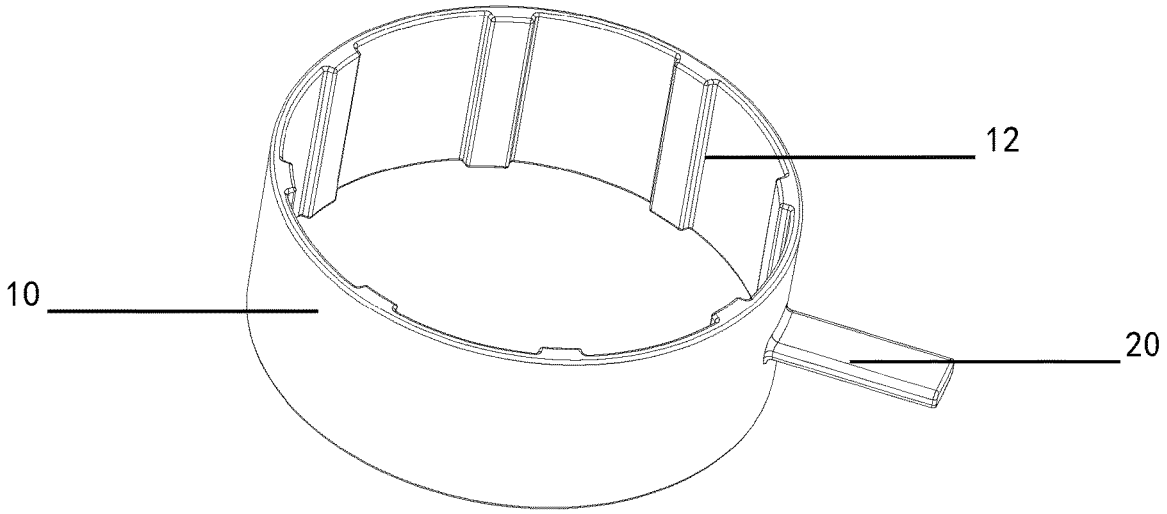
FIG. 11 illustrates a schematic diagram of the hood.

In the exemplary embodiment, the barrier 5 includes several spaced-apart baffles 11 around the base 4, and the gaps between adjacent baffles 11 form the second passage 6. The hood 10 is equipped with notched ledges 12 spaced apart along the inner bottom edge, as shown in FIG. 11. Each notched ledge 12 is preferably set along the entire vertical direction of the inner wall of the hood 10. When the bottom of the notched ledge 12 falls on the base 4, the baffles 11 are wedged between notched ledges 12, and the hood 10 seals the first chamber.

Figure 10:
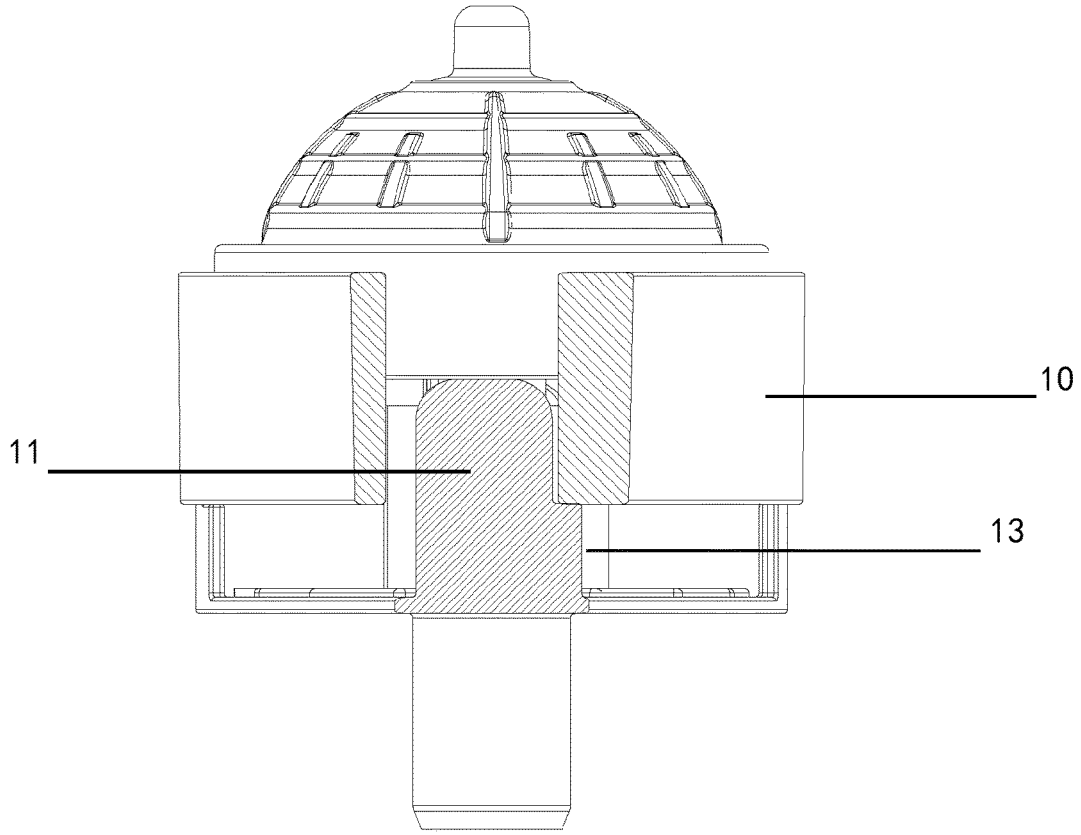
FIG. 10 illustrates a schematic diagram of the hood resting on the block.

In the preferred embodiment, the baffles 11 are provided with several blocks 13 protruding towards the side edges along the vertical direction, as shown in FIG. 10. The hood 10 adjusts the size of the second passage 6 by falling on different blocks 13.

Figure 8:
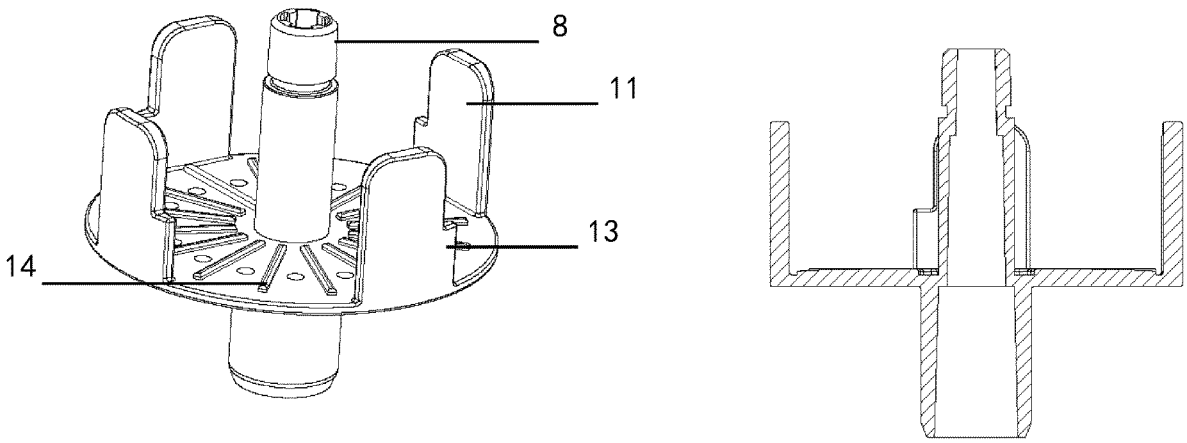
FIG. 8 illustrates a three-dimensional view (left) and a sectional view (right) of the charcoal tray with the non-threaded central column.
Figure 9:
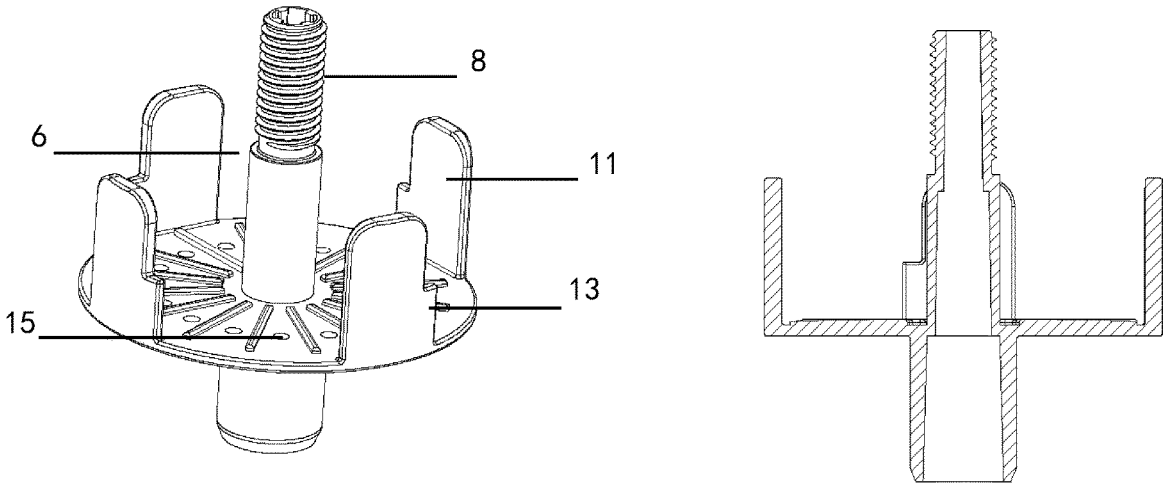
FIG. 9 illustrates a three-dimensional view (left) and a sectional view (right) of the charcoal tray with the threaded upper end of the central column.

In the exemplary embodiment, as shown in FIGS. 8-9, the first passage of the base includes several air flow ribs 14 extending outward from the center of the base 4 and several air flow holes 15 set between the air flow ribs 14.

In the preferred embodiment, the tobacco bowl 3 has a connecting hole 16 at its center, which is connected to the central column 8. The section of the tobacco bowl 3 from the rim to the connecting hole 16 is arc-shaped and open upwards. The tobacco bowl 3 also has several temperature control holes 17 that communicate with the first chamber. The arc-shaped design allows for more even heating of the hookah tobacco, and the hot air in the charcoal tray can enter the tobacco bowl through the temperature control holes, providing more efficient heat for the hookah tobacco. Moreover, when the temperature in the charcoal tray is adjusted by moving the hood, the heat changes can quickly be transmitted to the tobacco bowl through the temperature control holes, achieving more efficient control over the size of the hookah smoke.

Figure 6:
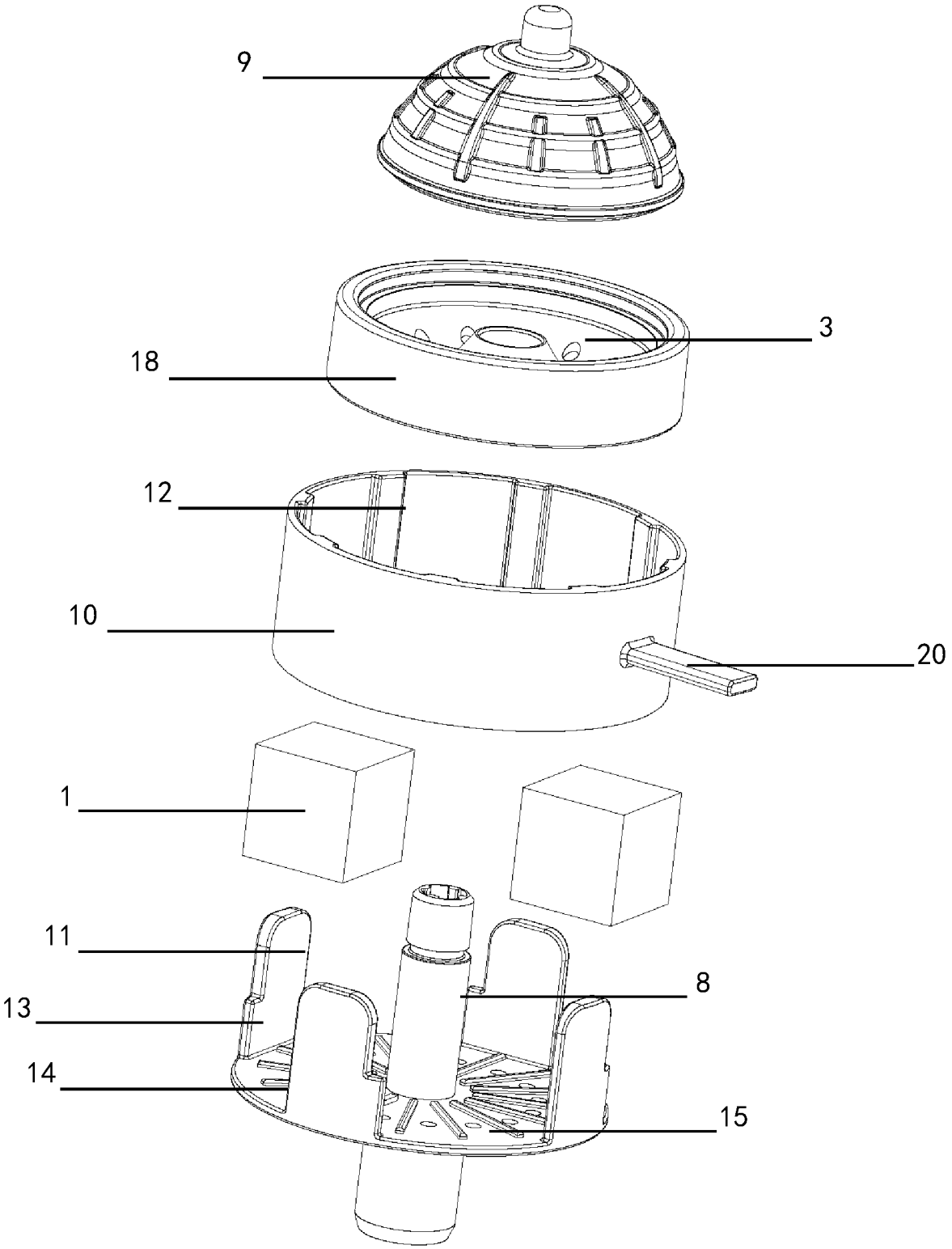
FIG. 6 illustrates an exploded view of the hookah heating device with the non-threaded central column.

In one exemplary embodiment, as shown in FIG. 6 and FIG. 8, the central column 8 is a non-threaded central column, and the connecting hole 16 of the tobacco bowl 3 is directly fitted onto the outer end of the central column 8, tightly coordinated by a column hole.

Figure 7:
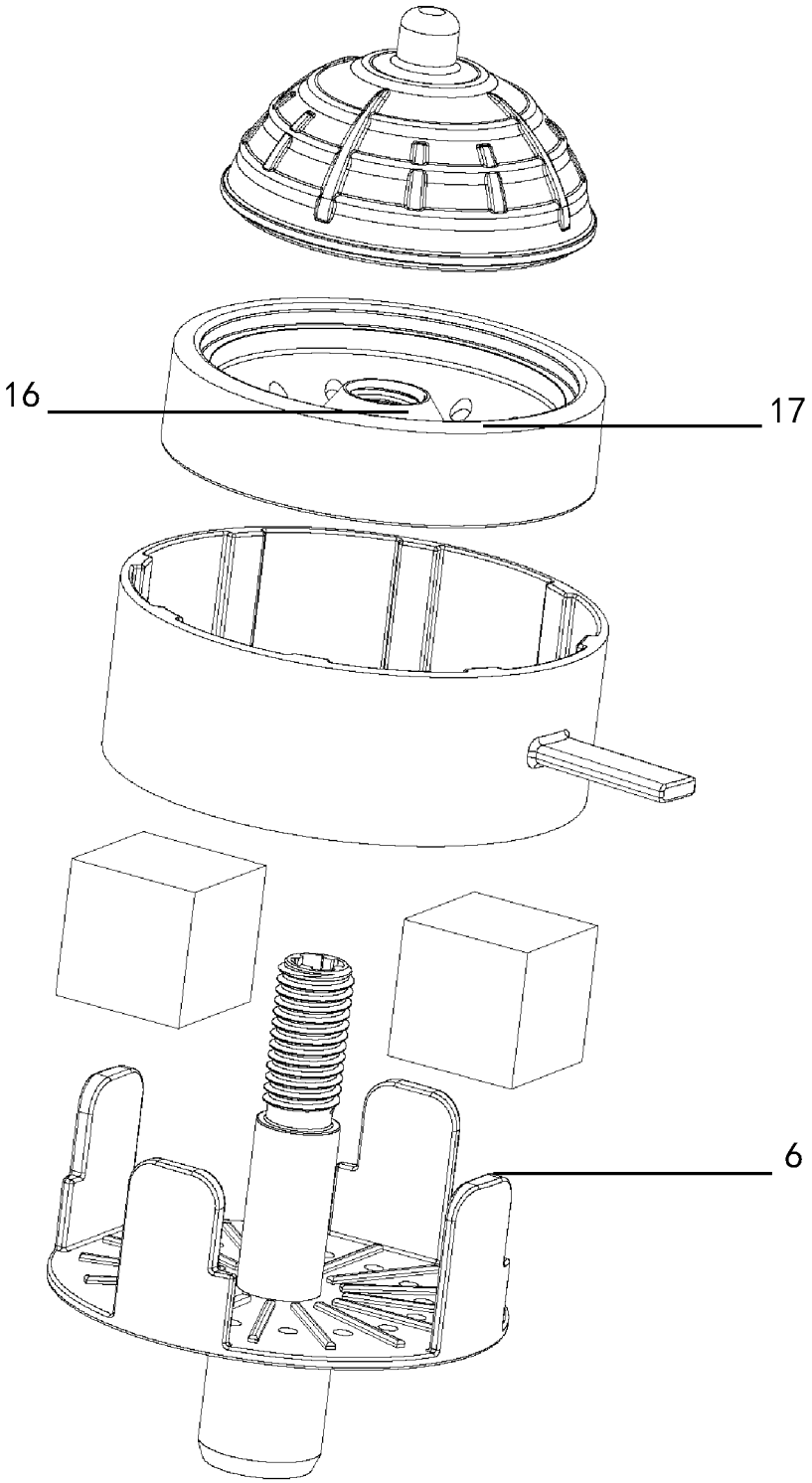
FIG. 7 illustrates an exploded view of the hookah heating device with the threaded upper end of the central column.

In another preferred exemplary embodiment, as shown in FIG. 7 and FIG. 9, the upper end of the central column 8 is provided with external threads, and the connecting hole 16 is provided with internal threads that match the external threads. The central column 8 and the connecting hole 16 are connected by the external and internal threads.

By combining the bowl with the central column of the charcoal tray through threads, the distance between the charcoal tray 2 and the bowl 3 can be adjusted by rotating the bowl. Therefore, when the smoke cannot reach the desired smoking state quickly through the hood 10, the bowl can be rotated to increase the distance between the charcoal tray 2 and the bowl 3, allowing heat to dissipate quickly into the air, thus achieving the purpose of controlling the smoking volume quickly. When adding hookah tobacco or cleaning the bowl, the bowl can be rotated to completely separate it from the central column.

Figure 12:
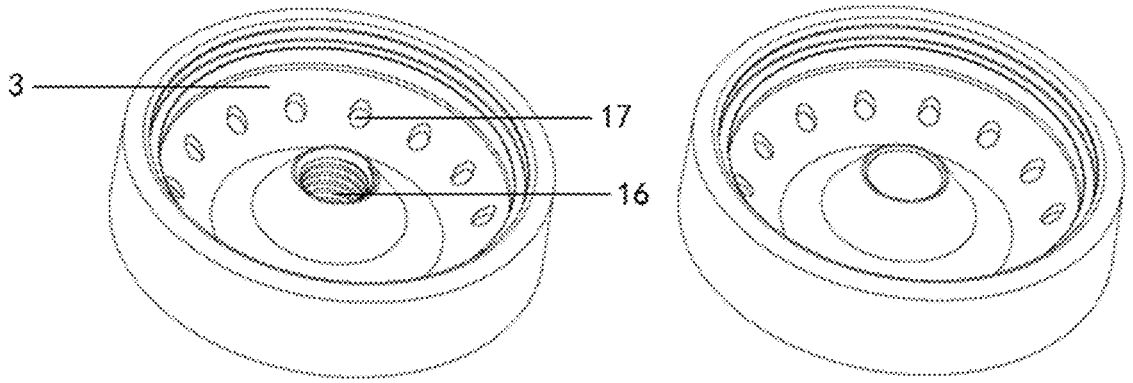
FIG. 12 illustrates schematic diagrams of the tobacco bowl structure with threaded connection (left) and non-threaded connection (right) to the central column.
Figure 13:
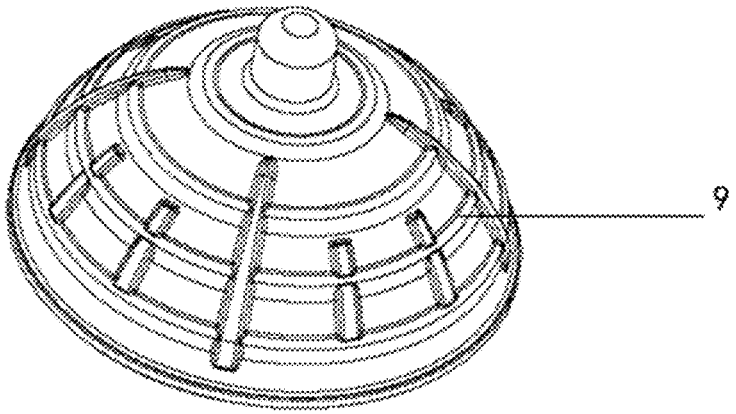
FIG. 13 illustrates a schematic diagram of the cover body.
Figure 14:
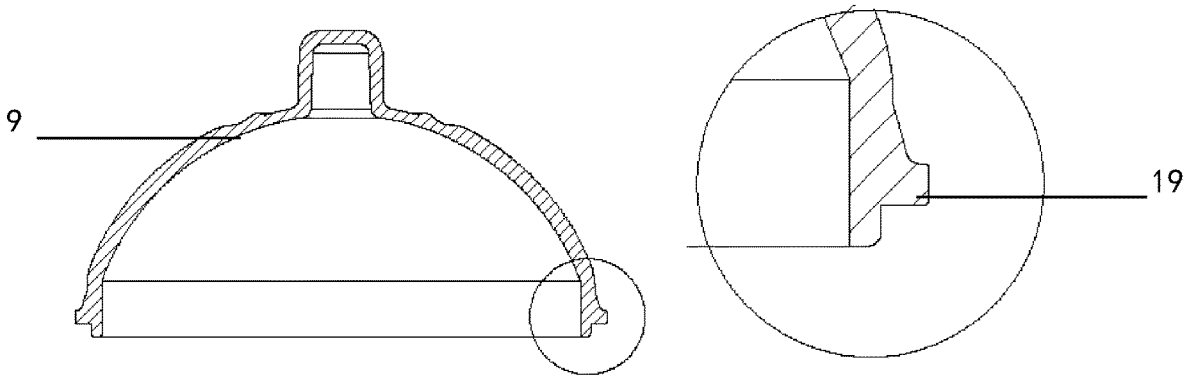
FIG. 14 illustrates a partially enlarged view of the sectional view of the cover body (middle) and the sealing protrusion (right).

In the preferred embodiment, as shown in FIG. 12, the rim of the bowl 3 is provided with a downward-extending bowl cover 18 with a height not less than that of the bowl 3. In a more preferred embodiment, as shown in FIG. 14, the cover body 9 is provided with a horizontally outward-extending sealing protrusion 19 at the connection with the rim of the bowl, which is used to seal the second chamber between the cover body 9 and the bowl 3. In a further preferred embodiment, the bowl cover 18 is equipped with a rotating handle (not shown in the figure) made of heat-resistant material for rotating the bowl 3.

The above-described embodiments and applications are merely illustrative examples of the present application and are not intended to limit the scope of the present application. Various modifications and improvements made by those skilled in the art to the technical solutions of the present application fall within the scope of protection as defined by the claims of the present application, without departing from the spirit of the present application.

What is claimed is:

1. A hookah heating device comprising a charcoal tray for holding charcoal and a bowl for holding tobacco; wherein the charcoal tray comprises a base and a barrier arranged around the base, the barrier comprises a plurality of spaced-apart baffles arranged around the base, the base has a first flow passage for air circulation, and the barrier has a second flow passage for air circulation; the center of the base is provided with a central column connected to a smoke pipe, and the bowl is detachably connected to an upper end of the central column and communicates with the central column, the top of the bowl is provided with a cover body; an outer side of the barrier is provided with a hood that can move up and down relative to the barrier to adjust the size of the second flow passage; when the second flow passage is completely blocked by the hood, the hood seals a first chamber between the base and the bottom of the bowl.

2. The hookah heating device according to claim 1, wherein the barrier is provided with at least one adjustment member along the vertical direction, and the hood adjusts the size of the second flow passage by falling on the at least one adjustment member.

3. The hookah heating device according to claim 2, wherein gaps between adjacent baffles form the second flow passage; the hood is provided with inwardly protruding notched ledges at intervals on the inner wall bottom; when the notched ledges fall on the base, the baffles are clamped between adjacent notched ledges, and the hood seals the first chamber.

4. The hookah heating device according to claim 3, wherein the adjustment member is a block which protrudes from a side edge along a vertical direction of each baffle, and the notched ledges adjust the size of the second flow passage by falling on different blocks.

5. The hookah heating device according to claim 1, wherein the center of the bowl is provided with a connecting hole connected to the central column; the cross section of the bowl from the rim to the connecting hole is arc-shaped and open upwards.

6. The hookah heating device according to claim 5, wherein the bowl is provided with several temperature control holes that communicate with the first chamber.

7. The hookah heating device according to claim 5, wherein the upper end of the central column is provided with external threads, and the connecting hole is provided with internal threads that match the external threads; the central column and the connecting hole are connected by the external threads and the internal threads.

8. The hookah heating device according to claim 7, wherein the rim of the bowl is provided with a downwardly extending bowl cover, a height of the bowl cover is not lower than a height of the bowl; the cover body is provided with a horizontally outward extending sealing protrusion at the connection with the rim, for sealing the second chamber between the cover body and the bowl.

9. The hookah heating device according to claim 8, wherein the hood is provided with an adjustment handle for moving the hood up and down, and the bowl cover is provided with a rotating handle for rotating the bowl.

* * * * *